US009242759B2

(12) United States Patent
Scott

(10) Patent No.: US 9,242,759 B2
(45) Date of Patent: Jan. 26, 2016

(54) CONTAINER WITH GRIPS

(76) Inventor: William Mitchell Scott, Villa Hills, OH (US)

( * ) Notice: Subject to any disclaimer, the term of this patent is extended or adjusted under 35 U.S.C. 154(b) by 0 days.

(21) Appl. No.: 13/441,434

(22) Filed: Apr. 6, 2012

(65) Prior Publication Data

US 2012/0267385 A1 Oct. 25, 2012

Related U.S. Application Data

(60) Provisional application No. 61/478,551, filed on Apr. 25, 2011.

(51) Int. Cl.
*B65D 25/10* (2006.01)
*B65D 5/468* (2006.01)
*B65D 5/68* (2006.01)

(52) U.S. Cl.
CPC ..... *B65D 5/4608* (2013.01); *B65D 5/68* (2013.01)

(58) Field of Classification Search
CPC ..... B65D 5/46088; B65D 5/46152; B65D 5/46192; B65D 5/46128; B65D 5/4612; B65D 5/4608; B65D 5/68
USPC ..... 220/676, 770; 229/117.13–117.17
See application file for complete search history.

(56) References Cited

U.S. PATENT DOCUMENTS

| | | | | |
|---|---|---|---|---|
| 1,457,770 | A | | 6/1923 | Dodge |
| 1,623,547 | A | | 4/1927 | Neumann |
| 1,897,672 | A | | 2/1933 | Neumann |
| 1,974,674 | A | | 9/1934 | Halladay et al. |
| 2,054,355 | A | | 9/1936 | Anderson, Jr. |
| 2,094,054 | A | * | 9/1937 | Bixby ..... 229/127 |
| 2,124,409 | A | | 7/1938 | Andrews |
| 2,201,462 | A | * | 5/1940 | Wells et al. ..... 229/199 |
| 2,253,008 | A | | 8/1941 | Anderson, Jr. |
| 2,289,619 | A | | 7/1942 | Anderson, Jr. |
| 2,297,284 | A | * | 9/1942 | Blackman ..... 206/139 |
| 2,307,349 | A | | 1/1943 | Anderson, Jr. |
| 2,307,350 | A | | 1/1943 | Anderson, Jr. |
| 2,365,182 | A | | 12/1944 | Ferguson |
| 2,418,963 | A | | 4/1947 | Anderson, Jr. |
| 2,460,230 | A | | 1/1949 | Makrianes |
| 2,537,801 | A | | 1/1951 | Swatsick |
| 2,559,552 | A | | 7/1951 | Welshenbach |
| 2,561,979 | A | | 7/1951 | George |
| 2,604,255 | A | | 7/1952 | Welshenbach |
| 2,629,499 | A | | 2/1953 | Welshenbach |

(Continued)

FOREIGN PATENT DOCUMENTS

WO WO 99/25621 5/1999

OTHER PUBLICATIONS

PCT Search Report and Written Opinion for Corresponding PCT Application No. PCT/US2012/037402; mailed Feb. 14, 2013 (15 pages).

*Primary Examiner* — Anthony Stashick
*Assistant Examiner* — James Way
(74) *Attorney, Agent, or Firm* — Patents on Demand P.A.; Brian K. Buchheit; Scott M. Garrett

(57) ABSTRACT

The invention provides for containers having grips and structure. More specifically, such ergonomic grips and structure enable a human's ability to lift and hold such containers easily and without significant strain on a human's body resulting from physical stress of a the container itself and/or a weighted load within the container.

22 Claims, 11 Drawing Sheets

(56) References Cited

U.S. PATENT DOCUMENTS

| | | | | | |
|---|---|---|---|---|---|
| 2,645,353 | A | | 7/1953 | Anderson, Jr. | |
| 2,788,933 | A | * | 4/1957 | Kessler | 229/117.16 |
| 3,002,650 | A | | 10/1961 | Lovell | |
| 3,049,279 | A | | 8/1962 | Mairs et al. | |
| 3,107,041 | A | | 10/1963 | Wagner, Jr. | |
| 3,114,493 | A | * | 12/1963 | Dunkin | 206/511 |
| 3,138,283 | A | | 6/1964 | Peebles | |
| 3,175,750 | A | * | 3/1965 | Bump | 229/117.14 |
| 3,186,586 | A | | 6/1965 | Box | |
| 3,195,798 | A | | 7/1965 | Wilson | |
| 3,282,462 | A | | 11/1966 | Box | |
| 3,301,386 | A | | 1/1967 | Carter | |
| 3,314,532 | A | | 4/1967 | Henry | |
| 3,366,496 | A | | 1/1968 | Bomar et al. | |
| 3,379,341 | A | | 4/1968 | Miles | |
| 3,438,562 | A | | 4/1969 | Connor et al. | |
| 3,664,494 | A | * | 5/1972 | Mergens | 206/45.22 |
| 3,667,666 | A | | 6/1972 | Pryor | |
| 3,670,949 | A | | 6/1972 | Galanes | |
| 3,684,159 | A | | 8/1972 | Wolfe | |
| 3,692,231 | A | | 9/1972 | Neitzke et al. | |
| 3,698,625 | A | * | 10/1972 | Graser | 206/434 |
| 3,713,579 | A | | 1/1973 | Chaffers | |
| 3,724,920 | A | | 4/1973 | Beck | |
| 3,797,731 | A | * | 3/1974 | Weldon | 229/117.16 |
| 3,844,473 | A | | 10/1974 | Whelan | |
| 3,860,113 | A | * | 1/1975 | Helms | 206/185 |
| 3,862,687 | A | * | 1/1975 | Pirman | 206/527 |
| 3,952,940 | A | * | 4/1976 | Malcolm | 229/117.31 |
| D242,021 | S | | 10/1976 | Shanklin | |
| 4,030,600 | A | | 6/1977 | Heaps | |
| 4,101,052 | A | | 7/1978 | Dove | |
| 4,127,228 | A | * | 11/1978 | Hall | 229/117.16 |
| 4,142,665 | A | * | 3/1979 | Jewell et al. | 229/132 |
| 4,172,522 | A | | 10/1979 | Muller et al. | |
| 4,230,261 | A | * | 10/1980 | Austin | 229/117 |
| 4,265,391 | A | | 5/1981 | Zornes et al. | |
| 4,285,150 | A | | 8/1981 | Richardson et al. | |
| 4,291,830 | A | | 9/1981 | Sorensen | |
| D263,899 | S | | 4/1982 | Lynn | |
| 4,325,493 | A | | 4/1982 | Paige | |
| 4,380,290 | A | | 4/1983 | Leubke | |
| 2,822,973 | A | | 2/1985 | Armstrong et al. | |
| 4,588,077 | A | * | 5/1986 | Champlin et al. | 206/193 |
| 4,617,702 | A | | 10/1986 | Diederich, Jr. | |
| 4,768,704 | A | | 9/1988 | Beckway et al. | |
| 4,817,861 | A | | 4/1989 | Henrikson | |
| 4,927,074 | A | | 5/1990 | LaRue et al. | |
| 4,961,497 | A | | 10/1990 | Sherer et al. | |
| D312,531 | S | | 12/1990 | Sherer et al. | |
| 5,042,657 | A | | 8/1991 | Dunn | |
| D326,341 | S | | 5/1992 | Frauhiger | |
| D348,390 | S | | 7/1994 | Van Ness | |
| 5,333,777 | A | * | 8/1994 | Roth | 229/117.16 |
| 5,429,295 | A | | 7/1995 | Levy | |
| D361,892 | S | | 9/1995 | Quaintance | |
| 5,494,161 | A | | 2/1996 | Herbst | |
| 5,503,324 | A | | 4/1996 | Bacchetti et al. | |
| 5,570,834 | A | * | 11/1996 | Larson et al. | 229/117.11 |
| 5,699,959 | A | | 12/1997 | Huspeka et al. | |
| D391,079 | S | | 2/1998 | Conti et al. | |
| D394,950 | S | | 6/1998 | Kite | |
| 5,779,129 | A | | 7/1998 | Herbst et al. | |
| 5,794,780 | A | * | 8/1998 | Parrella et al. | 206/459.5 |
| D398,228 | S | | 9/1998 | Herbst et al. | |
| D398,230 | S | | 9/1998 | Herbst et al. | |
| 5,890,650 | A | | 4/1999 | Penson | |
| 5,908,152 | A | | 6/1999 | Tullis | |
| D421,183 | S | | 2/2000 | Koskinen | |
| D422,499 | S | | 4/2000 | Herbst et al. | |
| D423,587 | S | | 4/2000 | Conley et al. | |
| D424,117 | S | | 5/2000 | Steinbeck et al. | |
| D425,128 | S | | 5/2000 | Conley et al. | |
| D425,562 | S | | 5/2000 | Conley et al. | |
| 6,059,180 | A | | 5/2000 | Collins | |
| 6,123,254 | A | | 9/2000 | Dupuis | |
| 6,149,052 | A | | 11/2000 | Mueller | |
| 6,237,840 | B1 | * | 5/2001 | Grabowski et al. | 229/117.16 |
| 6,290,124 | B2 | * | 9/2001 | Andrews et al. | 229/117.27 |
| D448,567 | S | | 10/2001 | Buss | |
| D453,275 | S | | 2/2002 | Stravitz | |
| D461,120 | S | | 8/2002 | Ostro | |
| 6,439,452 | B1 | * | 8/2002 | Tsao | 229/120.15 |
| 6,705,515 | B2 | | 3/2004 | Dowd | |
| D494,759 | S | | 8/2004 | Louie et al. | |
| D495,490 | S | | 9/2004 | Garrett et al. | |
| D507,404 | S | | 7/2005 | Moon et al. | |
| D518,526 | S | * | 4/2006 | Benn | D19/90 |
| D526,893 | S | | 8/2006 | Nixon | |
| D539,036 | S | | 3/2007 | Potts et al. | |
| D542,033 | S | | 5/2007 | Kopenhaver et al. | |
| D569,105 | S | | 5/2008 | Van Hoorn | |
| 7,410,094 | B2 | | 8/2008 | Bos | |
| 7,438,198 | B2 | | 10/2008 | Pickles | |
| D599,202 | S | | 9/2009 | Whiteside | |
| 7,611,020 | B2 | | 11/2009 | Prest | |
| 7,654,408 | B2 | | 2/2010 | Bazany | |
| D615,775 | S | | 5/2010 | Fairbanks | |
| 7,726,552 | B2 | | 6/2010 | Chadima | |
| D627,562 | S | | 11/2010 | Osiecki et al. | |
| D633,296 | S | | 3/2011 | Potts et al. | |
| 8,079,474 | B1 | | 12/2011 | Flaming | |
| D657,562 | S | | 4/2012 | McNamara | |
| D658,407 | S | | 5/2012 | Pung et al. | |
| D661,096 | S | | 6/2012 | Dretzka | |
| D678,058 | S | | 3/2013 | Vanden Boom et al. | |
| D680,428 | S | | 4/2013 | Vanden Boom et al. | |
| 2005/0241971 | A1 | | 11/2005 | Zou et al. | |
| 2005/0284906 | A1 | | 12/2005 | Potts et al. | |
| 2008/0054059 | A1 | | 3/2008 | Chadima | |
| 2009/0282843 | A1 | * | 11/2009 | Brand | 62/62 |
| 2010/0314268 | A1 | * | 12/2010 | Goodman | 206/281 |

* cited by examiner

CONTAINER WITH GRIPS

CROSS REFERENCE TO RELATED APPLICATION

This non-provisional patent application claims priority to Provisional Patent Application No. 61/478,551 filed on Apr. 25, 2011 the substance of which patent application is incorporated herein by reference.

FIELD OF THE INVENTION

The invention provides for containers having grips positioned about a carryable item that provide some beneficial ergonomic effects when lifting or holding the carryable item. More specifically, such grips and structure enable a person's ability to lift and hold such containers easily and without significant strain on a human's body resulting from physical stress of the container itself and/or a weighted load within the container.

BACKGROUND OF THE INVENTION

Lifting heavy items and then holding them towards the front of the human body can be burdensome and unhealthy. Depending upon the body type of the holder, the danger of additional stress and strain upon that body can be especially odious. When one lifts a heavy box, say forty pounds or more, a number of physiological responses occur. In such lifting and holding a person uses her arms, shoulders, upper back, lower back, buttocks, legs and feet to lift and to hold the box securely. The lower back especially can serve as a pivot point at which great strain can be applied depending upon how a body adjusts to the front-loaded weight. If that person has any physical weaknesses or physical degenerative attributes, those weaknesses can manifest and will be exploited in a manner that causes the person pain, noticeable discomfort, and/or injury.

Whether a strong or weak body, repetitive motions in lifting heavy items can lead to, at the least, chronic pain or discomfort and ultimately injury. For either pain, discomfort or injury, expensive ameliorative solutions for work place injuries. Work place injuries and pain from those injuries cost companies and governments billions of dollars per year.

When injuries to a person occur as a result of stress incurred from lifting and holding front loaded weight items, a number of losses can also occur. That person can lose time at her job as a result of being injured. During that time of injury, recovery time is needed to enable the worker to be healed. If this injury occurred on the job, insurance to pay for the injury derived from, for example, worker's compensation insurance, is used to compensate for lost wage earnings. When time is taken off due to injury and an injured worker is paid insurance, that person's employer loses the benefit of the worker's productivity and earning capacity.

Homes and businesses alike require the lifting and carrying of items therethrough. Often these items, e.g., laundry baskets, trash cans, industrial containers, industrial parts, and the like, are carried multiple times to multiple locales within and without a home, office or industrial structure. Many times, items to be carried are created with little thought given to their ergonomic impact on the human form. Their design, therefore, can lend itself to pain, discomfort or injury to a the human form that carries the item.

Many businesses across many industries use containers to store documents, materials and the like. A common container for such use is a corrugated file box. Such file boxes are used in the hundreds of millions to hold and store any and all sorts of items that can fit within them. Typically, these boxes carry up to forty pounds or more of materials within them. When a human holds one of these weight loaded boxes (e.g., having forty pounds or more therein), multiple physical stresses ensue. In particular, stress to the lower and back shoulders and arms occur, such stress leading to significant injury over time.

When a person holds a heavy box, e.g., thirty pounds or more, either by handles embedded within the box or by its sides or bottom, and that person has a weak lower back, say from a previous back surgery, such holding can cause immeasurable pain and potential new injury.

In such previously known boxes the standard, slit handles found in the boxes therein have not changed for fifty or more years. In corrugated boxes, in particular, that box and its handles, if any, have seen no change or improvement since the introduction of that style of box over seventy years ago.

In fact, when a human user lifts and holds a commonly used and known corrugated box with handles, a number of changes immediately occur to that person's body. When the user holds that known box (or other containers similar to it) with her arms extended, the top of the box and/or lid of the box will lie at an angle against the legs or lower torso of the holder. Because the box is weighted, the human user's center of gravity is shifted from her natural position within her body to a point outside of her body to compensate for the box's weight. This shift of the user's center of gravity shifts the user's naturally weighted stance from her heels to the front of her feet and along her toes. Such orientation can be painful and is not sustainable over time. This is true because lifting and/or holding a container or box engages muscles in the back, arms, shoulders, torso, core, hips and legs. It also puts the holder in an unbalanced position that can cause slips or falls as a holder holds the box and moves with it.

Also, when the holder's center of gravity is shifted her body operates instantly to counteract such shift and to support the weight pulling upon the front of her body. Such weight pull is compensated by most of the user's major muscle groups and in particular those about her lower back and torso.

What is needed, therefore, is a container using one or more grips coupled with the use of weighted items like a box that limits the shift of a box holder's center of gravity when the holder lifts and/or holds a weighted item thus relieving undue physical stress on the holder's muscles and joints.

BRIEF SUMMARY OF THE INVENTION

Accordingly, the invention provides a mass-bearing item having at least one grip and preferably at least a pair of grips. The mass-bearing item comprises a structure having a first surface, a second surface positioned oppositely to the first surface, a first grip mechanism or grip positioned about the first surface and a second grip mechanism positioned about the second surface, a front surface, a rear surface positioned oppositely to the front surface. The front surface and the rear surface are perpendicularly connected to the first surface and the second surface. The structure is movable by use of the first grip mechanism and the second grip mechanism.

Each grip herein is positioned a distance closer to the front surface of the structure and a distance away from the rear surface—i.e., the biased position of each grip herein. Each grip has a contoured outer portion having a perimeter. The perimeter has an upper gripping portion that has a surface upon which at least one finger on a human hand may grasp to apply a force, and a lower portion positioned oppositely to the gripping portion.

An opening is positioned between the gripping portion and the lower portion. The opening provides clearance through which at least one finger on a human hand may grip the gripping portion. The opening comprises a first end, and a second end positioned substantially opposite to the first end. The first end and the second end connect the gripping portion and the lower portion along the perimeter of the contoured outer portion.

In practice, the combination of one or more grips, the grips' biased forward positioning on carryable-item or box and the curved structure of the grips themselves serve to re-align a human holder's center of gravity closer to a human holder's neutral position when the human holder lifts, holds or walks with the mass-bearing item. In one preferred embodiment herein, the first grip is positioned through the first panel and the second grip is positioned oppositely to the first grip mechanism through the third panel.

Preferably, the mass-bearing item is a box and most preferably a box whose dimensions are less than or equal to the shoulder of an average sized adult human. Typically, the box comprises a first panel having a top edge, a bottom edge positioned oppositely to the top edge, a first connecting edge and a second connecting edge positioned oppositely to the first connecting edge. The box further comprises a second panel having a top edge, a bottom edge positioned oppositely to the top edge, a first connecting edge and a second connecting edge positioned oppositely to the first connecting edge.

The second panel is attached to the first panel along the first connecting edge of the second panel and the second connecting edge of the first panel. A third panel of the box has a top edge, a bottom edge positioned oppositely to the top edge, a first connecting edge and a second connecting edge positioned oppositely to the first connecting edge. The third panel is attached to the second panel along the first connecting edge of the third panel and the second connecting edge of the second panel. The box's fourth panel has a top edge, a bottom edge positioned oppositely to its top edge, a first connecting edge and a second connecting edge positioned oppositely to its first connecting edge. The fourth panel is attached to the third panel along the first connecting edge of the fourth panel and the second connecting edge of the third panel, and connected to the first panel along the second connecting edge of the fourth panel and the first connecting edge of the first panel. The box further comprises a bottom panel of at least one panel connected to the bottom edges of the first panel, the second panel, the third panel and the fourth panel. An opening is formed from the top edges of the first panel, the second panel, the third panel and the fourth panel of said box.

The box preferably comprises a lid. The lid comprises a top surface having a first edge connected to a second edge. The second edge is connected to a third edge. The third edge is connected to a fourth edge. The fourth edge is connected the first edge. The lid has a skirt extending downwardly from the top surface of the lid. The skirt is connected to the lid at the first edge, the second edge, the third edge and the fourth edge, the skirt having a first panel connected to the first edge, a second panel connected to the second edge, a third panel connected to the third edge and a fourth panel connected to the fourth edge.

The lid comprises a first grip and a second grip positioned oppositely to the first grip. The first grip in the lid is positioned within the first panel of the skirt and the second grip mechanism in the lid is positioned within the third panel of the skirt. In practice, the first grip in the lid aligns with the first grip in the box and the second grip in the lid aligns with the second grip in the box when the lid is placed fully onto the box thereby covering the opening of the box. The first grip in the lid corresponds to placement for the right hand. The second grip in the lid corresponds to placement for the left hand.

The grips are biased forward on the box. That is, the first and second grips in or about the box are positioned closer to the second connecting edge of the first panel of the box and the second grip is positioned closer to the first connecting edge of the third panel of the box. By their biased position, the grips are positioned further away from the front of a holder's body than grips or ports known in the prior art.

Alternatively, the first grip in the box is positioned equidistant between the first connecting edge and the second connecting edge on the first panel of the box, and the second grip is positioned equidistant between the first connecting edge and the second connecting edge on the third panel of the box.

The first grip and the second grip are each positioned at an angle ranging from greater than about zero degrees to about ninety degrees from an x-axis. Preferably, the first grip and the second grip are each positioned at an angle ranging from greater than about five degrees to about seventy-five degrees from an x-axis. More preferably, the first grip and the second grip are each positioned at an angle ranging from greater than about fifteen degrees to about fifty degrees from an x-axis. Most preferably the first grip and the second grip are positioned at the same angle on their respective box panels.

In an alternative embodiment herein, the upper grip portion of the first and second grips mechanism are each positioned at an angle ranging from greater than about zero degrees to about ninety degrees from an x-axis. Further, the upper grip portion of the first grip and the second grip are each positioned at an angle ranging from greater than about five degrees to about seventy-five degrees from an x-axis. Lastly, the upper grip portion of the first grip and the second grip are each positioned at an angle ranging from greater than about fifteen degrees to about fifty degrees from an x-axis.

Another embodiment of the invention herein also provides an ergonomic grip or grip for moving a carryable item. The grip comprises a contoured outer portion having a perimeter. The contoured outer portion has an angle of curvature ranging from greater than zero degrees to less than about ninety degrees from a first normal position or frame of reference; herein, a first x-axis. Further, an upper gripping portion is provided that has a gripping surface upon which at least one finger on a human hand may grasp the grip to apply a force thereto. The upper gripping portion has an angle ranging from greater than zero degrees to less than about ninety degrees from a second normal position or frame of reference; herein, a second x-axis. A lower non-gripping portion is positioned oppositely to the upper gripping portion.

An opening or indentation or protrusion is positioned between the upper gripping portion and the lower non-gripping portion of the grip. The opening provides clearance through which at least one finger on a human hand may grip the upper gripping portion. The opening or indentation or protrusion also comprises a first end and a second end positioned substantially opposite to the grip's first end. The grip's first end and its second end connect the upper gripping portion and the lower non-gripping portion along the grip's perimeter of its contoured outer portion. For the sake of simplicity, an opening, indentation, or protrusion shall henceforth be described and called an opening.

In practice, the grip is attached to a surface of a carryable item. Preferably a pair of grips are attached to or embedded within a carryable item. Use of the grip re-aligns a human carrier's center of gravity thus relieving tension upon pivot points in the human body. Also, use of the grips help to return the human form substantially back to its neutral position. For example, the grips, when used in a pairing and positioned oppositely to one-another on or embedded within a carryable item, move the human carrier's center of gravity back to the starting point of a human carrier's center of gravity.

The grip is movable from greater than about zero degrees to less than about ninety degrees between its x-axis and y-axis. In one embodiment herein, the grip is rotatable about its z-axis between its x-axis and y-axis.

Herein, the grip is attachable to a surface of a carryable item. Once attached, the carryable item becomes movable by a human holder's use of the grip. One or more of the grips are attachable to a surface of a carryable item whereby the carryable item becomes movable by the holder's use of the grips. As mentioned hereinbefore, the grips may be constructed into a carryable item.

BRIEF DESCRIPTION OF THE DRAWINGS

While the specification concludes with claims particularly pointing out and distinctly claiming the invention, it is believed that the embodiments set forth herein will be better understood from the following description in conjunction with the accompanying figures, in which like reference numerals identify like elements and in which:

DETAILED DESCRIPTION

Figure 1:
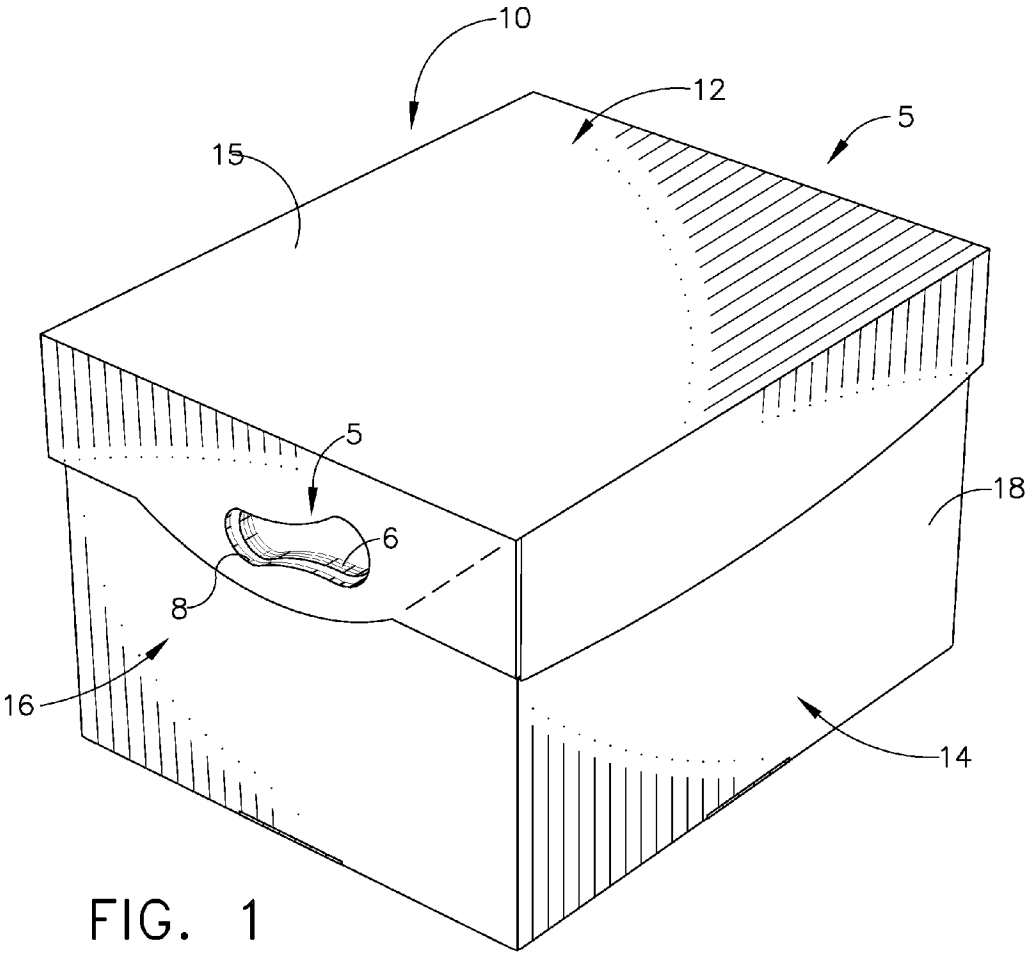
FIG. 1 is a perspective view of a preferred carryable item of the invention herein that is a box.

By the term "attached" as used herein it means that an grip may be either attached to the surface of a carryable item as a separate and distinct item from the carryable item or the grip may be built into a carryable item be embedded therein.

By the term "carryable item" it is meant any item regardless of geometric configuration that may be carried by a human being.

By the term "center-of-gravity" it is meant herein that point within or outside of a human body at which the entire weight of a body may be considered to be concentrated.

The term "grip" or "ergonomic grip" is defined herein as a fixed or moveable, permanent or temporary handle, observation hole or opening, grip or any other opening or impression that could accommodate a hand(s) or thumb(s). The grip system was conceived to lessen the stress on the human body and improve the balance of the load across the hand and fingers, and the entire body. The grip consists of at least these components separately or together.

By the term "normal position" it is meant herein an axis corresponding to zero degrees.

By the term "neutral position" it is meant herein that position of a standing, unburdened human in which that human's center of gravity is positioned within his body.

By the term "biased position" it is meant herein the position of a grip on one side of a carryable item or box wherein the centerline of the grip is biased forward of the centerline of the panel on which the grip is positioned and rests closer to the front of the carryable item or box than the rear of the carryable item or box.

The invention provides a mass-bearing item having at least a pair of grip mechanisms. The mass-bearing item comprises a structure having a first surface, a second surface positioned oppositely to the first surface, a first grip positioned about the first surface and a second grip positioned about the second surface, a front surface, a rear surface positioned oppositely to the front surface. The front surface and the rear surface are perpendicularly connected to the first surface and the second surface. The structure is movable by use of the first grip and the second grip. It is noted herein that the terms "grip mechanism", "grip", "ergonomic grip(s)" are interchangeable.

Each grip or grip herein is positioned a distance closer to the front surface of the structure and a distance away from the rear surface - - - i.e., the biased position of each grip herein. Each grip has a contoured outer portion having a perimeter. The perimeter has an upper gripping portion that has a surface upon which at least one finger on a human hand may grasp to apply a force, and a lower portion positioned oppositely to the gripping portion.

An opening is positioned between the gripping portion and the lower portion. The opening provides clearance through which at least one finger on a human hand may grip the gripping portion. The opening comprises a first end, and a second end positioned substantially opposite to the first end. The first end and the second end connect the gripping portion and the lower portion along the perimeter of the contoured outer portion.

In practice, the combination of one or more grips, the grips' biased forward positioning on carryable-item or box and the curved structure of the grips themselves serve to re-align a human holder's center of gravity closer to a human holder's neutral position when the human holder lifts, holds or walks with the mass-bearing item. In one preferred embodiment herein, the first grip mechanism positioned through the first panel and the second grip mechanism is positioned oppositely to the first grip mechanism through the third panel.

Preferably, the mass-bearing item is a box and most preferably a box whose dimensions are less than or equal to the shoulder of an average sized adult human. Typically, the box comprises a first panel having a top edge, a bottom edge positioned oppositely to the top edge, a first connecting edge and a second connecting edge positioned oppositely to the first connecting edge. The box further comprises a second panel having a top edge, a bottom edge positioned oppositely to the top edge, a first connecting edge and a second connecting edge positioned oppositely to the first connecting edge. The second panel is attached to the first panel along the first connecting edge of the second panel and the second connecting edge of the first panel. A third panel of the box has a top edge, a bottom edge positioned oppositely to the top edge, a first connecting edge and a second connecting edge positioned oppositely to the first connecting edge. The third panel is attached to the second panel along the first connecting edge of the third panel and the second connecting edge of the second panel. The box's fourth panel has a top edge, a bottom edge positioned oppositely to its top edge, a first connecting edge and a second connecting edge positioned oppositely to its first connecting edge. The fourth panel is attached to the third panel along the first connecting edge of the fourth panel and the second connecting edge of the third panel, and connected to the first panel along the second connecting edge of the fourth panel and the first connecting edge of the first panel. The box further comprises a bottom panel of at least one panel connected to the bottom edges of the first panel, the second panel, the third panel and the fourth panel. An opening is formed from the top edges of the first panel, the second panel, the third panel and the fourth panel of said box.

The box preferably comprises a lid. The lid comprises a top surface having a first edge connected to a second edge. The second edge is connected to a third edge. The third edge is connected to a fourth edge. The fourth edge is connected the first edge. The lid has a skirt extending downwardly from the top surface of the lid. The skirt is connected to the lid at the first edge, the second edge, the third edge and the fourth edge. The skirt has a first panel connected to the first edge, a second panel connected to the second edge, a third panel connected to the third edge and a fourth panel connected to the fourth edge.

The lid comprises a first grip and a second grip positioned oppositely to the first grip. The first grip in the lid is positioned within the first panel of the skirt and the second grip mechanism in the lid is positioned within the third panel of the skirt. In practice, the first grip in the lid aligns with the first grip in the box and the second grip in the lid aligns with the second grip in the box when the lid is placed fully onto the box thereby covering the opening of the box.

The grips are biased forward on the box. That is, the first and second grips in or about the box are positioned closer to the second connecting edge of the first panel of the box and the second grip is positioned closer to the first connecting edge of the third panel of the box.

Alternatively, the first grip in the box is positioned equidistant between the first connecting edge and the second connecting edge on the first panel of the box, and the second grip is positioned equidistant between the first connecting edge and the second connecting edge on the third panel of the box.

The first grip and the second grip are each positioned at an angle ranging from greater than about zero degrees to about ninety degrees from an x-axis. Preferably, the first grip and the second grip are each positioned at an angle ranging from greater than about five degrees to about seventy-five degrees from an x-axis. More preferably, the first grip and the second grip are each positioned at an angle ranging from greater than about fifteen degrees to about fifty degrees from an x-axis. Most preferably the first grip and the second grip are positioned at the same angle on their respective box panels.

In an alternative embodiment herein, the upper grip portion of the first and second grips mechanism are each positioned at an angle ranging from greater than about zero degrees to about ninety degrees from an x-axis. Further, the upper grip portion of the first grip and the second grip are each positioned at an angle ranging from greater than about five degrees to about seventy-five degrees from an x-axis. Lastly, the upper grip portion of the first grip and the second grip are each positioned at an angle ranging from greater than about fifteen degrees to about fifty degrees from an x-axis.

Another embodiment of the invention herein provides an grip for moving a carryable item. The grip comprises a contoured outer portion having a perimeter. The contoured outer portion has an angle of curvature ranging from greater than zero degrees to less than about ninety degrees from a first normal position. Further, an upper gripping portion is provided that has a gripping surface upon which at least one finger on a human hand may grasp the grip to apply a force thereto. The upper gripping portion has an angle ranging from greater than zero degrees to less than about ninety degrees from a second normal position. A lower non-gripping portion is positioned oppositely to the upper gripping portion.

An opening is positioned between the upper gripping portion and the lower non-gripping portion of the grip. The opening provides clearance through which at least one finger on a human hand may grip the upper gripping portion. The opening also comprises a first end and a second end positioned substantially opposite to the grip's first end. The grip's first end and its second end connect the upper gripping portion and the lower non-gripping portion along the grip's perimeter of its contoured outer portion.

In practice, the grip is attached to a surface of a carryable item. Preferably a pair of grips are attached to or embedded within a carryable item. Use of the grip re-aligns a human carrier's center of gravity thus relieving tension upon pivot points in the human body. For example, the grips, when used in a pairing and positioned oppositely to one-another on or embedded within a carryable item, move the human carrier's center of gravity back to the starting point of a human carrier's center of gravity.

The grip is movable from greater than about zero degrees to less than about ninety degrees between its x-axis and y-axis. In one embodiment herein, the grip is rotatable about its z-axis between its x-axis and y-axis.

Herein, the grip is attachable to a surface of a carryable item. Once attached, the carryable item becomes movable by a human holder's use of the grip. At least a pair of the grips are attachable to a surface of a carryable item whereby the carryable item becomes movable by the holder's use of the grips. As mentioned hereinbefore, the grips may be constructed into a carryable item.

Preferably, the carryable item is a container. The container comprising a pair of said grips constructed within said container on opposing sides of said container. Preferably, the container is a box that comprises a first panel having a top edge, a bottom edge positioned oppositely to the top edge, a first connecting edge and a second connecting edge positioned oppositely to the first connecting edge. The box further comprises a second panel having a top edge, a bottom edge positioned oppositely to the top edge, a first connecting edge and a second connecting edge positioned oppositely to the first connecting edge. The second panel is attached to the first panel along first connecting edge of the second panel and the second connecting edge of the first panel. The box further has a third panel having a top edge, a bottom edge positioned oppositely to the top edge. A first connecting edge and a second connecting edge are positioned oppositely to the first connecting edge. The third panel is attached to the second panel along the first connecting edge of the third panel and the second connecting edge of said second panel. The box further comprises a fourth panel having a top edge, a bottom edge positioned oppositely to the top edge, a first connecting edge and a second connecting edge positioned oppositely to the first connecting edge. The fourth panel is attached to the third panel along the first connecting edge of the fourth panel and the second connecting edge of the third panel, and connected to the first panel along the second connecting edge of the fourth panel and the first connecting edge of the first panel. Finally, the box comprises a bottom panel of at least one panel connected to the bottom edges of the first panel, the second panel, the third panel and the fourth panel, the box having a volume created by all of its side and panels.

FIG. 1 provides a perspective view of a preferred carryable item 10 or container 10 herein. The preferred container 10 is a box 12. Box 12, as shown, has the dimensions of a typical file box used for file storage and record keeping. Box 12 also has grips 5 that are biased forward toward box front panel 14. Lid 15 is shown attached to box 12. Lid 15 also has grips 5 which line up exactly with grips 5 in box 12, thereby providing handles through the lid and box together.

FIG. 1 provides a planar view of grip 5 herein attached to container 10 herein. Container 10 is box 12 that can be made from corrugate, plasticized corrugate, metal, composite materials, plastic and nearly any material suitable for use for forming a container for use as such.

FIG. 1 provides a view of a preferred embodiment of grips 5 used in box 12 that shows grips 5 being biased away from box rear panel 16 and toward box front panel 14. In practice, a user holds box 12 such that box rear panel 16 is the back of the box and is closest to the user, while box front panel 14 is the front of the box and faces away from a user.

Figure 2:
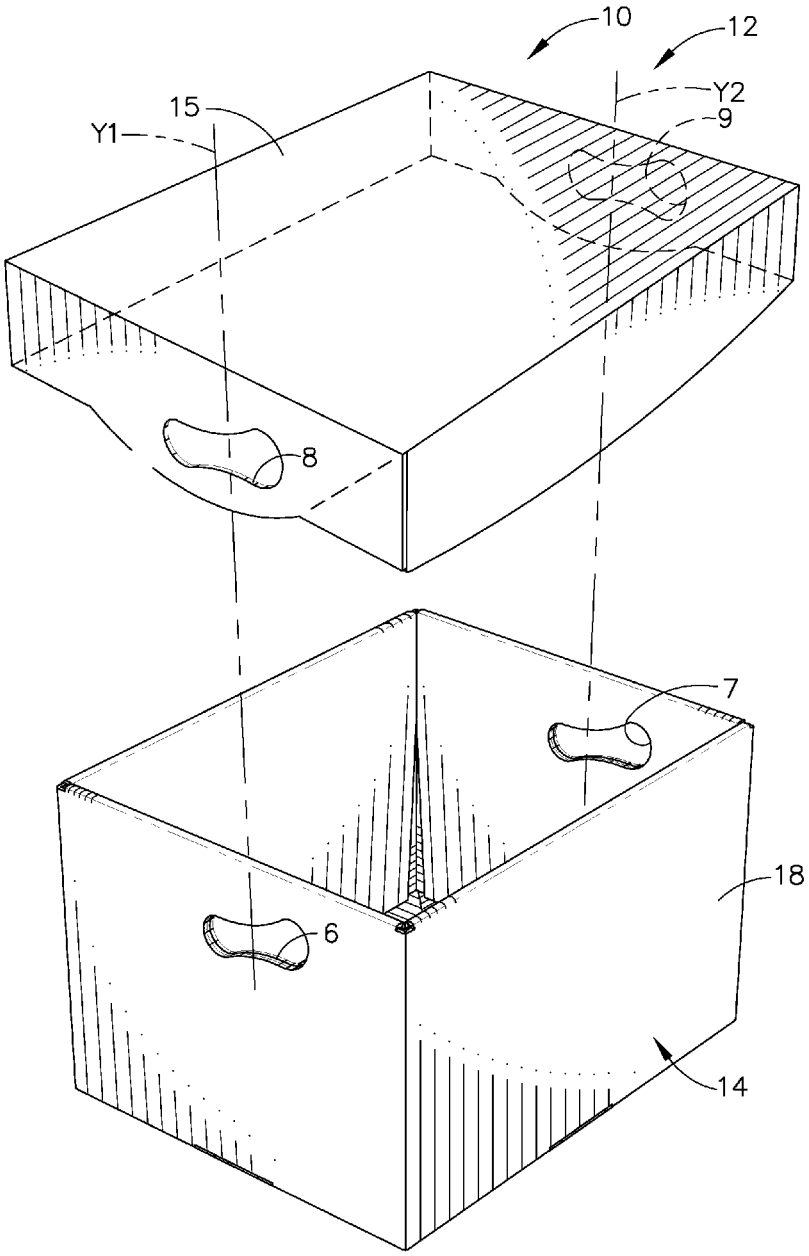
FIG. 2 is an exploded view of FIG. 1 showing the lid removed from the carryable item thereof.

FIG. 2 shows an exploded perspective view of box 12 of FIG. 1. FIG. 2 definitively shows that a pair of grips 5 are positioned in box 12 as well as in lid 15. Importantly, also shown are right side box grip 6, left side box grip 7, right side lid grip 8, and left side box grip 9. Right side box grip 6 is shown aligned exactly along line Y1 with right side lid grip 8. Similarly, left side box grip 7 is shown aligned exactly along line Y2 with left side lid grip 9. Such exact grip alignment is important for the function of the invention herein. Grips 6 and 8 and grips 7 and 9 must be properly aligned to allow a human hand to fit through lid 15 and box 12.

When a user picks up lid covered box 12, that user's right and left ands hold fast lid 15 to box body 18. Such configuration makes box 12 easier to hold and carry. Also, such configuration makes box 12 stronger and more resistant to compression forces.

Figure 3:
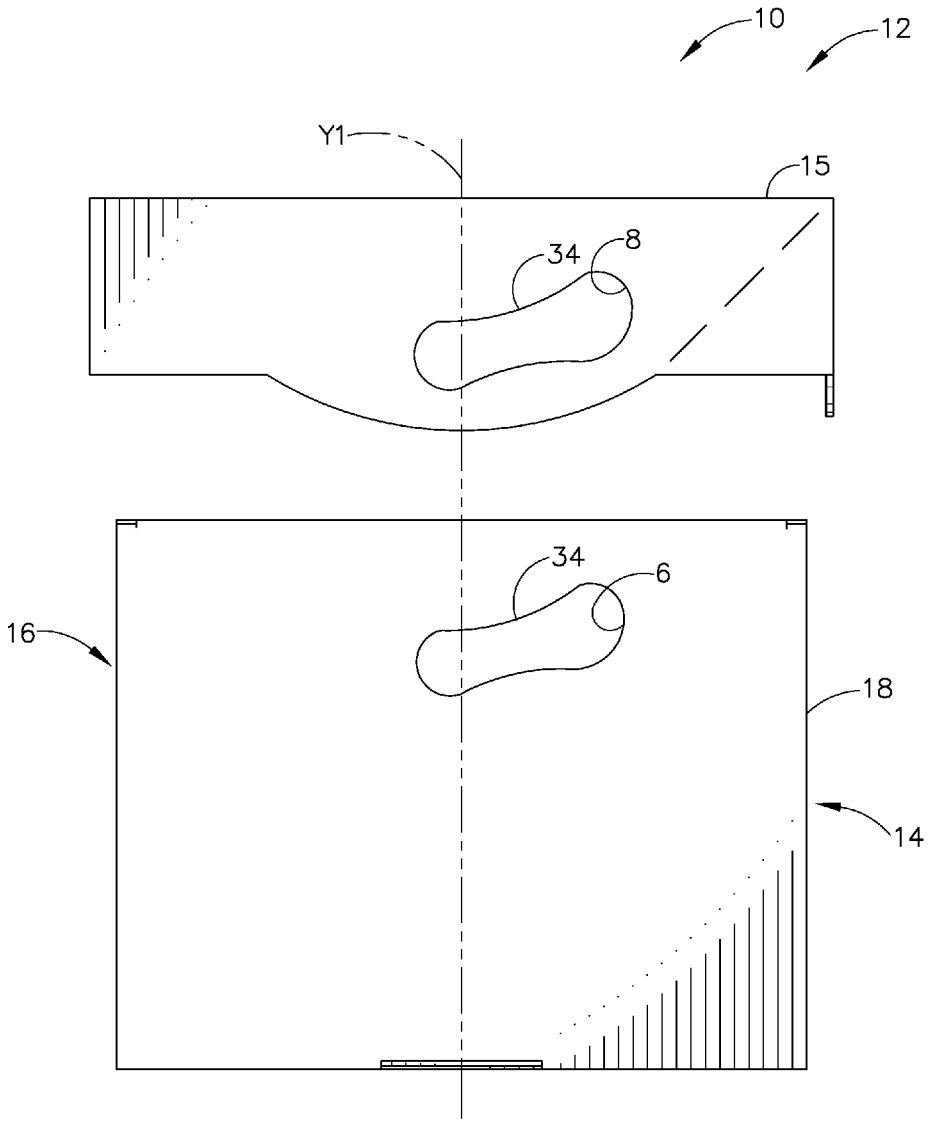
FIG. 3 is a planar side view of FIG. 2.

FIG. 3 provides a side planar view of box 12 of FIG. 2. Right side box grip 6 and right side lid grip 8 are shown biased forward of center line Y1. Center line Y1 is a center line dividing the distance equally between box front panel 14 and box rear panel 16. Grips 6 and 8 are shown with more than 50% of their perimeter surfaces on the right side of center line Y1 and thus biased forward to box front panel 14. Similarly, though not shown, left side box grip 7 and left side lid grip 9 are biased forward center line Y2 whereby more than 50% of the perimeter of grips 7 and 9 are biased forward to box front panel 14.

FIG. 3 shows that most of perimeter 34 of grips 6 and 8 reside on the side of centerline Y1 that is closest to box front panel 14. Conversely, a smaller portion of grips 6 and 8 perimeter 34 resides closest to box rear panel 16 - - - the same is true of grips 7 and 9. Such positioning of grip 5 is known herein as "bias" or as a "bias forward" positioning of grip 5. The biasing forward of grips 5 (6, 7, 8 and 9), aids to re-align a human's center of gravity by shifting it closer to such holder's natural, non-weighted center of gravity. This function is performed by allowing a user to hold the mass-bearing item in a manner most similar to the user's neutral posture or neutral position when standing without holding a mass-bearing item in the front of the user's body.

Figure 4:
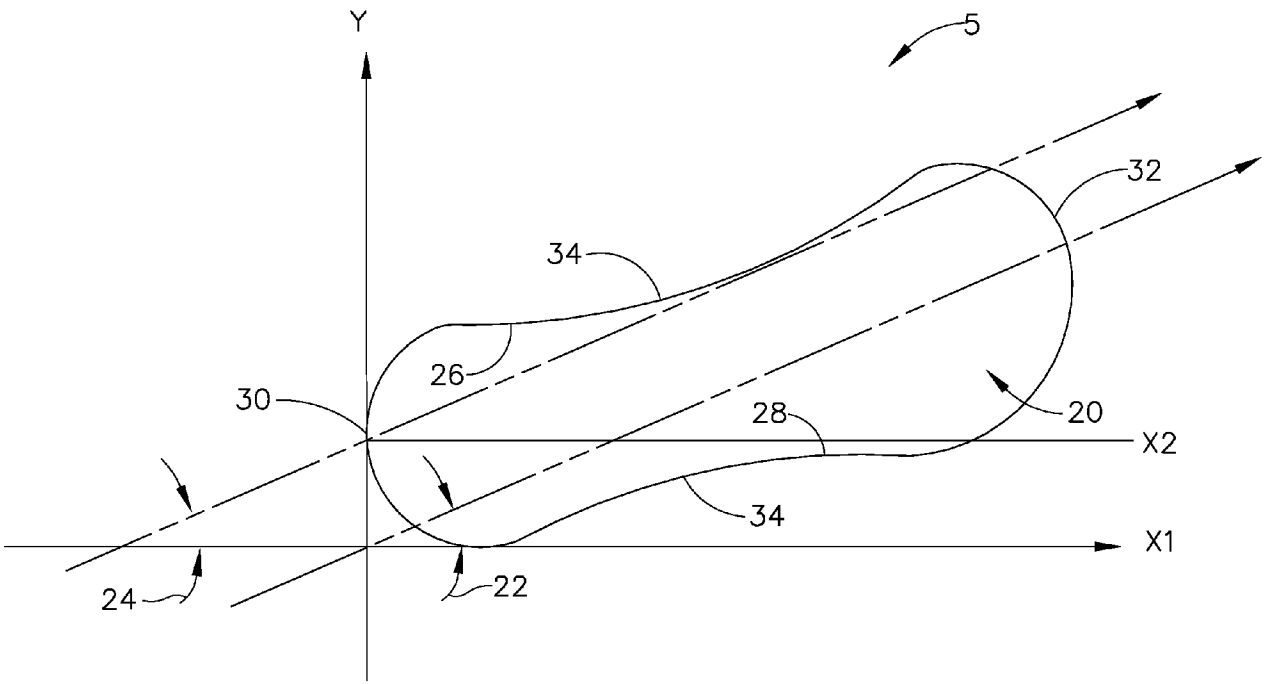
FIG. 4 is a planar view of a grip herein.

FIG. 4 shows an outline of grip 5. Grip 5 comprises perimeter 34. Grip 5 has an angle of curvature 22 ranging from greater than about zero degrees(0°) to less than about ninety degrees (90°) when measured from intersecting x and y axes as shown. Angle of curvature 22 is an average of the angled orientation of grip 5. Grip 5 comprises upper grip portion 26 extending from first end 30 to second end 32 of grip 5. Upper grip portion 26 provides gripping surface 27 upon which at least one finger on a human hand may grasp to apply an upward force to grip 5. Importantly, upper grip portion 26 has grip angle 24 ranging from greater than about zero degrees (0°) to less than about ninety degrees (90°) from an intersecting x-axis and y-axis. Contoured outer portion 35 further provides a lower portion 28 positioned oppositely to upper grip portion 26 that provides an area of clearance by which a user may readily hold grip 5 at upper grip portion 26.

As shown, in FIG. 4, grip 5 comprises an opening 20 positioned between the upper grip portion 26 and the lower grip portion 28. Opening 20 provides clearance through which at least one finger on a human hand may readily grip the upper grip portion 5 of grip 5. Grip 5 also has a first end 30 and a second end 32 positioned substantially opposite to the first end 30. First end 30 and second end 32 connect the upper grip portion 26 and lower grip portion 28 along perimeter 34 of contoured outer portion 35. In practice, grip 5 is already attached or is attachable to a surface of a mass-bearing item (e.g., a box).

Also, grip 5 may be rotatable about a z-axis (not shown). In such practice, grip 5 is not fixed at one angular position between an x-axis and a y-axis but instead is movable (i.e., rotatable) about a z-axis. When grip 5 is movable about its z-axis, i.e., movable about a point on its z-axis, it can be rotated between its x-axis and its y-axis from greater than about zero degrees to less than about ninety degrees thereof. Preferably, grip 5 is movable (i.e., rotatable) about a z-axis from about ten degrees (10°) to about seventy degrees (70°) of an angle of curvature.

Figure 5:
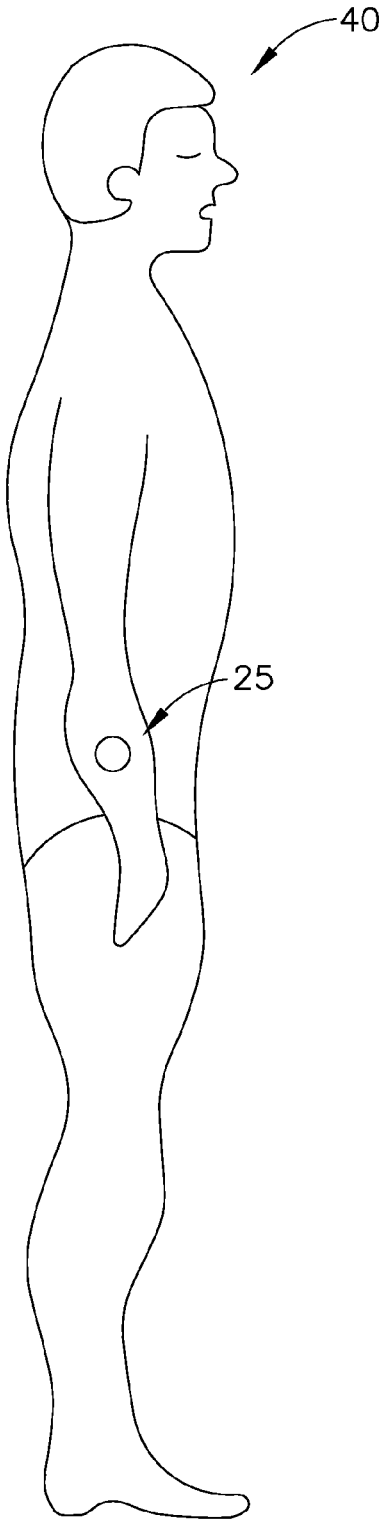
FIG. 5 is a side view of a person standing and shows that person's center of gravity.

FIG. 5 provides a figure of human 40. Human 40 is shown in a side view that shows his center of gravity 25 being resident within his body about mid-way between his feet and head. Human 40's center of gravity 25 remains centered within his body so long as human 40 is not carrying anything.

Figure 6:
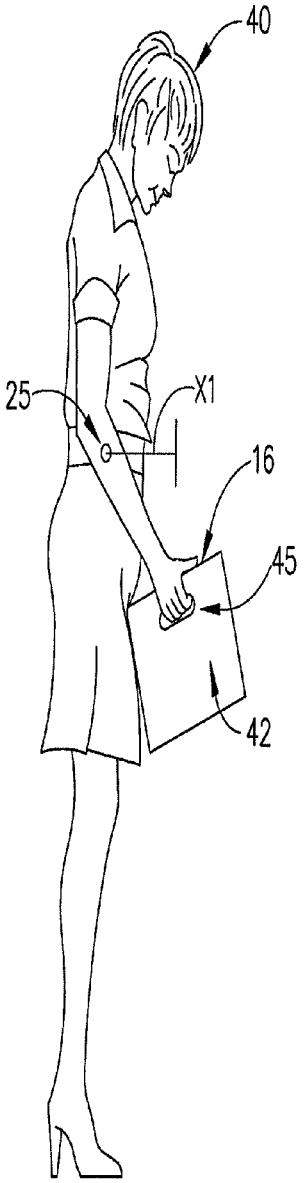
FIG. 6 Prior Art
FIG. 6 is a side view of a person holding a prior art container.

FIG. 6 shows human 40 carrying prior art box 42. In FIG. 5 human's center of gravity 25 is shown moved a distance $X_1$ from her body. When human 40 becomes front-loaded, i.e., when she carries prior art box 42 at the front of her body, her center of gravity 25 moves away from its original position within her body to a new position outside of her body as shown. The distance between her center of gravity 25 at rest and its new position is $X_1$. When the human body is in a standing position, such person's arms will hang to the sides of the person. Typically, in a normally functioning body, a human's hands will turn slightly inward toward the front of the body at between about four degrees (4°) to about seven degrees (7°).

Figure 7:
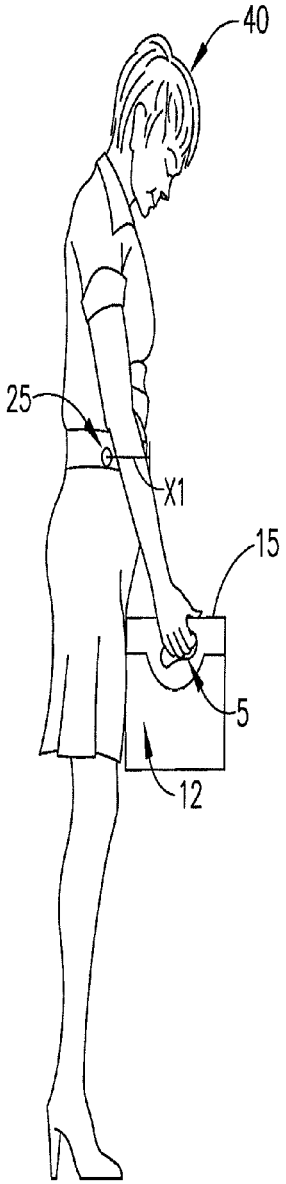
FIG. 7 is a side view of a person holding a preferred container herein with grips built therein.
Figure 8:
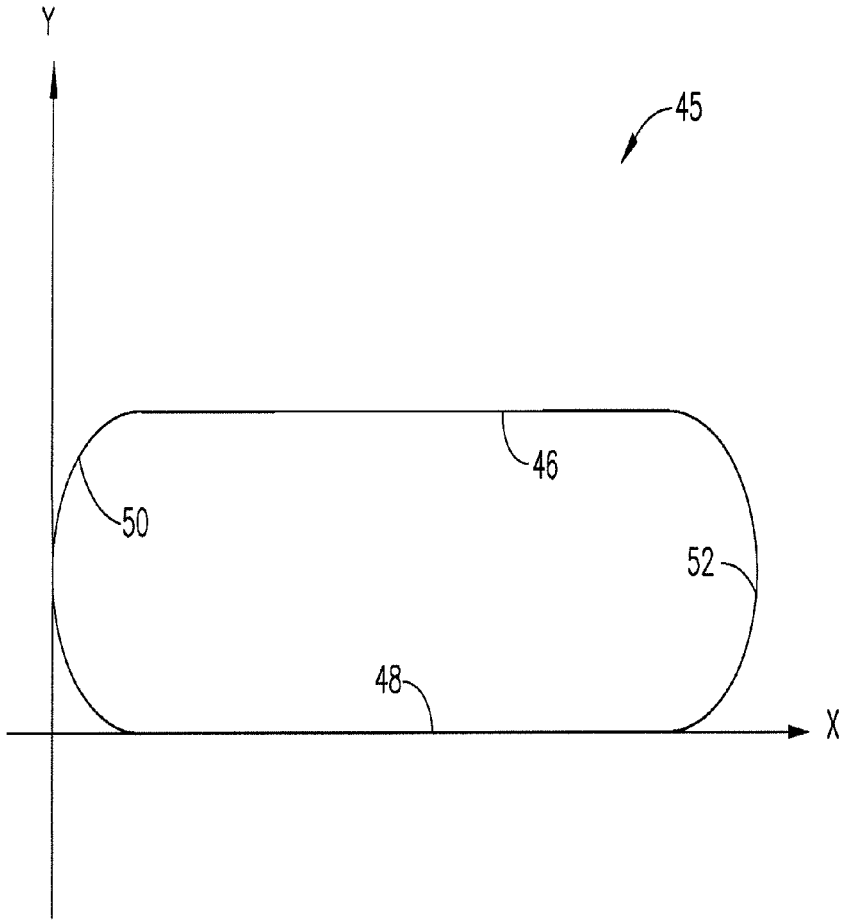
FIG. 8 Prior Art
FIG. 8 is a planar view of a prior art handle.
Figure 9:
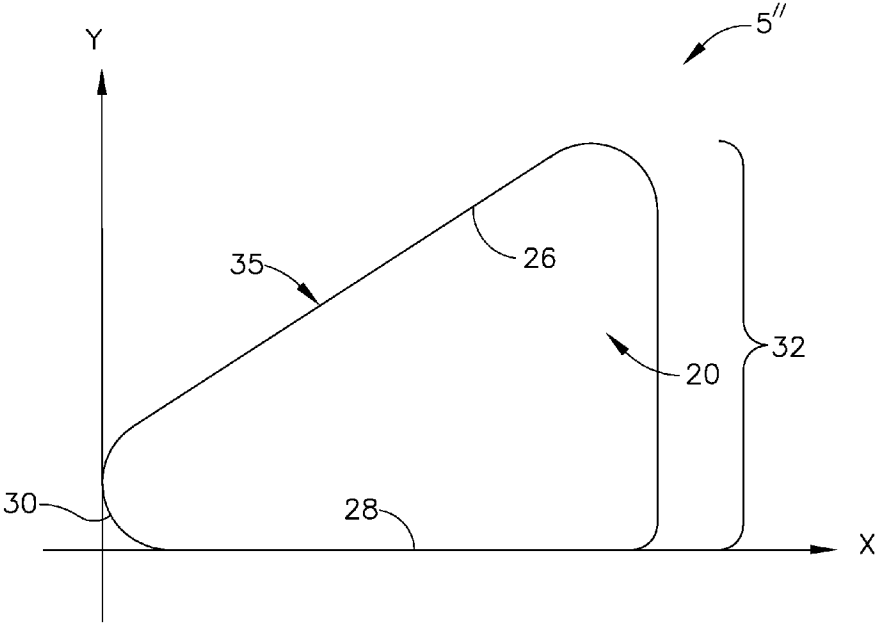
FIG. 9 is a planar view of an alternative embodiment of a grip showing one key angles of the grip being the same.
Figure 11:
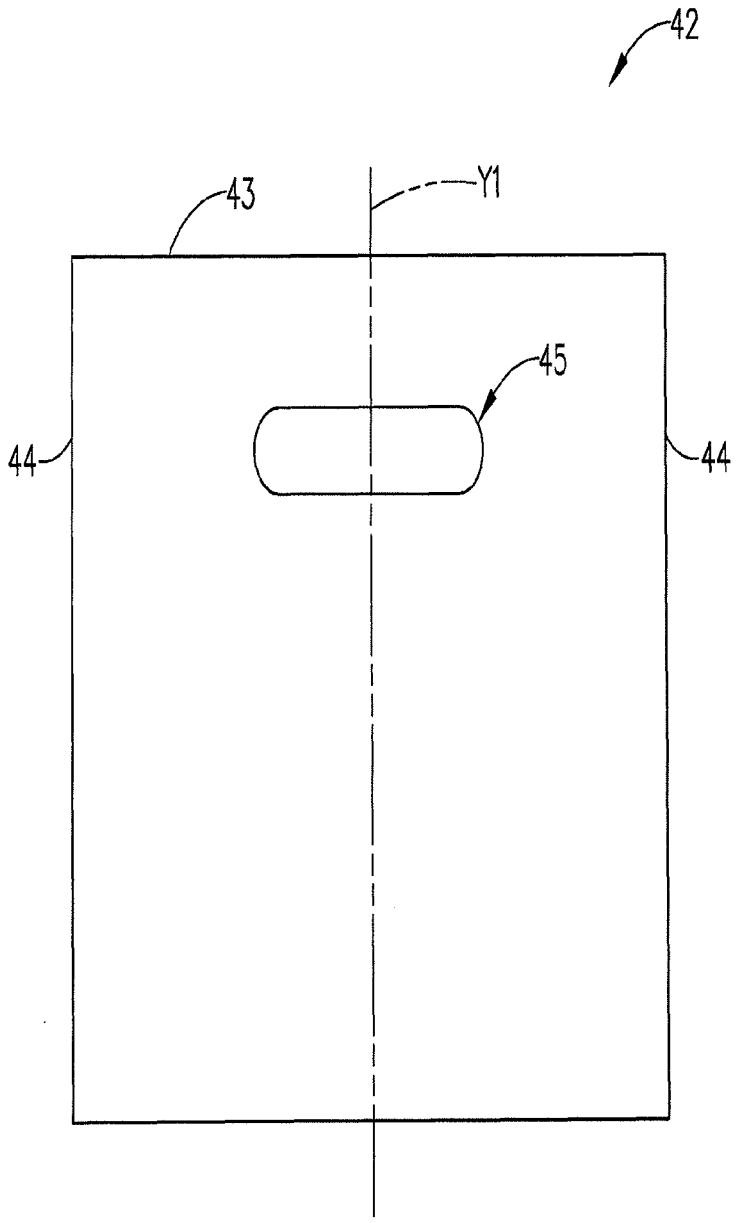
FIG. 11 Prior Art
FIG. 11 is a planar side view of a prior art box.

FIG. 6 and FIG. 7 each provide side profiles of a human 40 holding box 42 and box 12, respectively. Prior art box 42, as shown in FIG. 6, shows human 40 holding box 42. Box 42 is a known box commonly used for such tasks as file storage, moving, and the like. Box 42 contains prior art handles 45 that are commonly used for boxes of its type. Prior art handles 45, as shown in FIGS. 8 and 11 herein, are an opening on each side panel of box 42. Prior art handles 45 lack either an angle of curvature 22 (FIG. 11) or a grip angle 24 (FIG. 11), or such angle of curvature and grip angle are both zero degrees when measured from an x-axis. Also, prior art handles 45 are not biased forward of a center line and its each half of its perimeter is positioned equidistant to the front and rear of box 42 as is shown in FIG. 11.

Conversely, FIG. 7 provides a side view of human 40 holding box 12 with by grips 5. When human 40 holds box 12, she is front-loaded as in FIG. 6. However, her center of gravity 25 is either still resident within her body or it is moved to a position just outside of her body at a distance $X_2$ from its resting point. Herein, $X_2$ is a lesser distance than $X_1$. Use of grips 5 for box 12 therefore enables human 40 to be front loaded in a much less physically stressful manner.

For example, use of grips 5 as shown in FIG. 7 for box 12 enables human 40 to retain much more of her weight on the heels of her feet instead toward the front of her feet. Importantly, the bias of grip 5 produces several results. First, when box 12 is held by a human 40, and especially when box 12 is loaded beyond the weight of box 12 itself, the center of gravity of box 12 shifts from the center of box 12 rearwardly toward the back of box 12, namely box rear panel 16. Such shifting of box 12's center of gravity occurs at least in part because grips 5 are biased toward box front panel 14. Also aiding such center of gravity shift is the angled orientation of grips 5 as discussed previously hereinabove.

In practice, box 12 may be held by human 40 with his arms fully or nearly fully extended. In such orientation (FIG. 7), lid 15 is positioned parallel or substantially parallel with a flat surface upon which human 40 is standing. In such orientation of box 12, its center of gravity is shifted rearwardly toward human 40 without orientating box 12 at an angle whereby lid 15 would no longer be parallel to a flat surface upon which human 40 is standing. Instead, by such orientation box 12 may be held and subsequently carried at an orientation in which lid 15 is parallel or substantially parallel with a flat surface upon which human 40 is walking This is important not only for reasons of correctness in human 40 but also because box 12 may now become a carry surface upon which other similar boxes 12 can sit and be carried by human 40 and/or become a carry surface for other non-box items (e.g., folded clothing, books and the like).

Also in practice, the bias of grips 5 ranges from less than about fifty percent of perimeter 34 residing to the rear of centerline 19. Preferably, no more than about forty-five percent of perimeter 34 resides rearwardly of centerline 19. Even more preferably, no more than about forty percent of perimeter 34 resides rearwardly of centerline 19. If suitable, no more than about ten percent to about forty percent of perimeter 34 may reside rearwardly of centerline 19.

Figure 12:
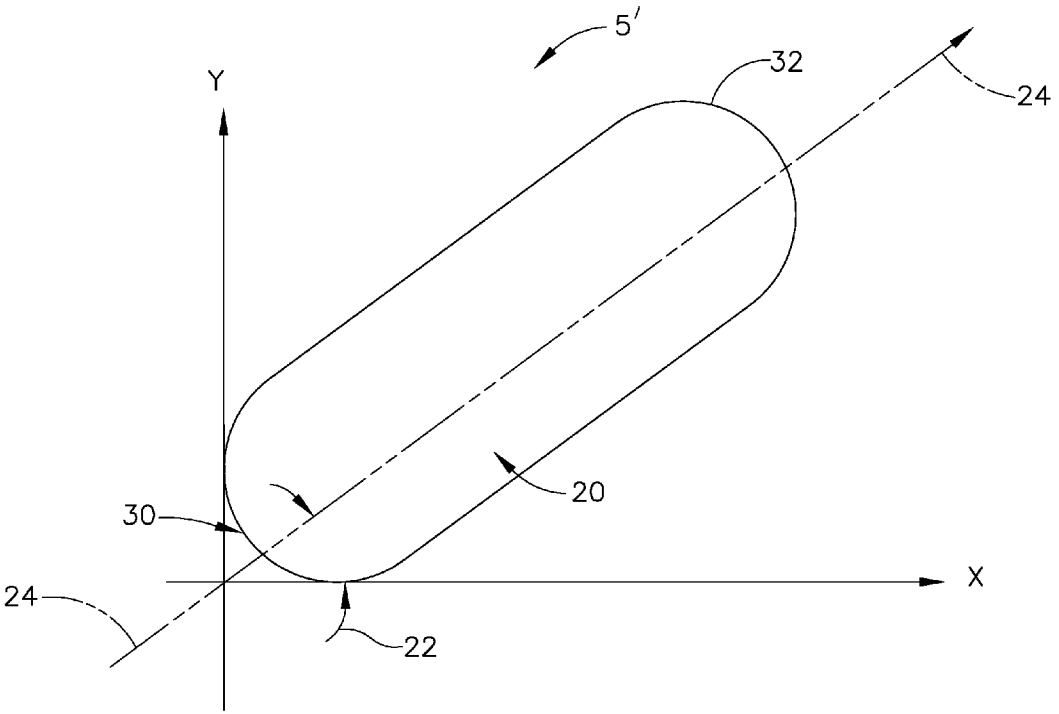
FIG. 12 is a planar view of an alternative grip herein.

In FIG. 12 an alternative embodiment of grip 5 is shown. Grip 5 herein, like that of FIG. 4, has an angle of curvature 22 and a grip angle 24. However, herein both the angle of curvature 22 and the grip angle 24 are the same. Such a configuration operates similarly to grips 5 in FIG. 4 inasmuch as there is a pronounced benefit of maintenance to a user's center-of-gravity when the user holds a container 10 herein whether loaded or un-loaded.

As shown in FIG. 12, alternate grip 5 comprises an opening 20 positioned between the upper grip portion 26 and the lower grip portion 28. Opening 20 provides clearance through which at least one finger on a human hand may readily grip the upper grip portion 5 of grip 5. Alternate grip 5 also has a first end 30 and a second end 32 positioned substantially opposite to the first end 30. First end 30 and second end 32 connect the upper grip portion 26 and lower grip portion 28 along perimeter 34 of contoured outer portion 35. In practice, grip 5 is already attached or is attachable to a surface of a mass-bearing item (e.g., a box).

Figure 10:
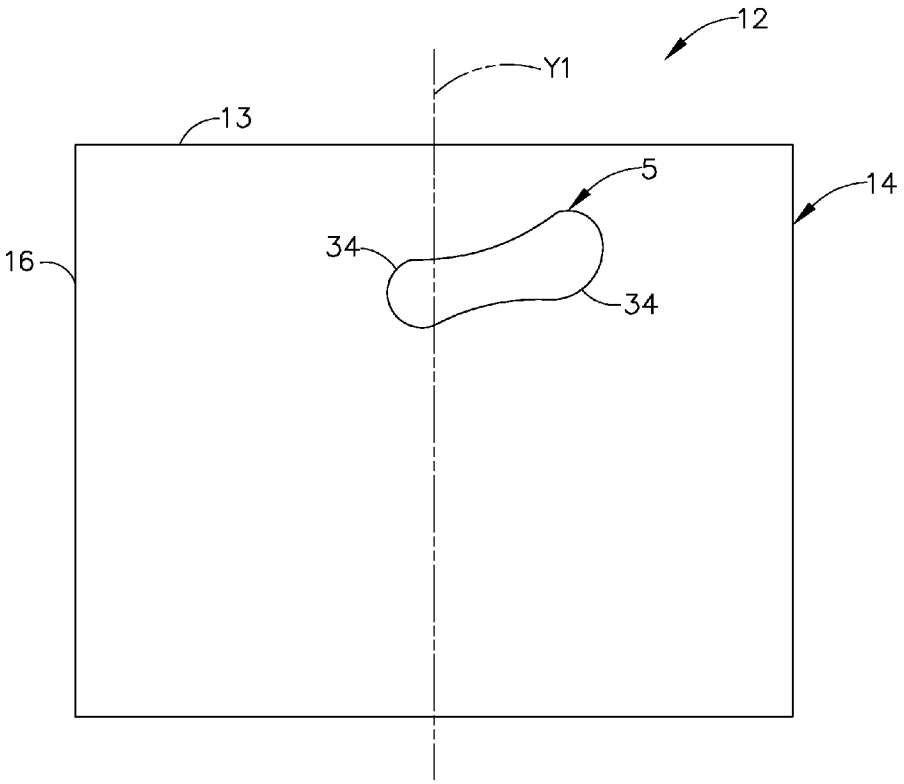
FIG. 10 is a planar side view of the carryable item of FIG. 3 without the lid.

Alternate grip 5 may be positioned on box 12 like grip 5 shown in FIG. 10; i.e., biased forward toward the box front panel 14. While alternate grip 5 does not provide the same ergonomic effects of grip 5 in FIG. 10 with respect to the curved upper grip portion 26 (FIG. 4), the angling of alternate grip 5 and its biased positioning still provides quantifiable ergonomic effects for shifting a person's center of gravity towards the body when box 12 using alternate grip 5 is lifted, held and/or carried using alternate grips 5.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A container having at least a pair of openings for gripping the container using a pair of human hands, said container comprising:

a container structure having four side surfaces, a bottom surface, and a top opening, said four side surfaces and bottom surface forming an interior concavity of the container structure, wherein the four side surfaces comprise a first surface, a second surface positioned oppositely to said first surface, a rear surface, and a front surface positioned oppositely to said rear surface wherein the first surface and the second surface include a first and second opening respectively that is a void through the first and second surfaces through which a human hand is insertable, wherein from a centerline evenly positioned between the front surface and the rear surface, the first and the second opening are forward biased towards the front surface, said forward bias results in ten percent to forty percent of the periphery of the first and second opening being rearward of the centerline and ninety to sixty percent of the periphery of the first and second openings being frontward of the centerline, wherein each of said first and second openings are upwardly angled from the centerline to the front surface at an angle between fifteen and fifty degrees relative to the bottom surface.

2. The container of claim 1, further comprising a lid for the container structure, wherein said lid comprises a first lid opening and a second lid opening, said first lid opening being a void within the lid that corresponds in opening periphery and angle with the first opening of the first side, wherein the second lid opening is a void that correspond in opening periphery and angle with the second opening of the second side, wherein the first and second lid openings are such that when the lid is placed over the top opening, the first lid opening aligns with the first opening and the second lid opening aligns with the second opening.

3. The container of claim 1, wherein the container is a box, wherein the each of the four sides is perpendicular to an adjacent side at an edge, wherein the bottom surface is perpendicular at an edge to each of the four sides.

4. The container of claim 1, wherein said lid comprises a top surface having a first edge connected to a second edge, said second edge being connected to a third edge, said third edge being connected to a fourth edge, said fourth edge being connected to said first edge, said lid having a skirt extending downwardly from said top surface of said lid, said skirt being connected to said lid at said first edge, said second edge, said third edge and said fourth edge, said skirt having a first panel connected to said first edge, a second panel connected to said second edge, a third panel connected to said third edge and a fourth panel connected to said fourth edge.

5. The container of claim 1, wherein the first and second openings are shaped and aligned in corresponding positions for a right hand and a left hand grip respectively.

6. The container of claim 1, wherein the forward bias results in between ten percent and twenty percent of the periphery of the first and second opening being rearward of the centerline and between eighty and ninety percent of the periphery of the first and second opening being forward of the centerline.

7. The container of claim 1, wherein the forward bias results in between twenty percent and thirty percent of the periphery of the first and second opening being rearward of the centerline and between seventy and eighty percent of the periphery of the first and second opening being forward of the centerline.

8. The container of claim 1, wherein the forward bias results in between thirty percent and forty percent of the periphery of the first and second opening being rearward of the centerline and between sixty and seventy percent of the periphery of the first and second opening being forward of the centerline.

9. The container of claim 1, wherein each of said first and second openings are upwardly angled from the centerline to the front surface at an angle between fifteen and twenty-five degrees relative to the bottom surface.

10. The container of claim 1, wherein each of said first and second openings are upwardly angled from the centerline to the front surface at an angle between twenty-five and thirty-five degrees relative to the bottom surface.

11. The container of claim 1, wherein each of said first and second openings are upwardly angled from the centerline to the front surface at an angle between thirty-five and forty-five degrees relative to the bottom surface.

12. The container of claim 1, wherein a height and length of the first and second sides are along an x and y axis, wherein the first opening and the second opening are part of a movable structure of the first and second sides, such that the movable structures are movable about a z-axis at an angle between ten and seventy degrees.

13. The container of claim 1, further comprising a lid, wherein the position and angle of the first and second openings is such that a human with arms fully or nearly fully extended gripping the container via the first and second openings, a center of gravity for the container is rearward to the human and the lid of the container is positioned parallel with a flat surface upon which the human is standing.

14. A box comprising:

a rectangular container structure having four side surfaces, each perpendicular to an adjacent side at an edge, a bottom surface perpendicular at an edge to each of the four sides, and a top opening, said four side surfaces and bottom surface forming an interior concavity of the container structure, wherein the four side surfaces comprise a first surface, a second surface positioned oppositely to said first surface, a rear surface, and a front surface positioned oppositely to said rear surface, wherein the first surface and the second surface include a first and second opening respectively that is a void through the first and second surfaces through which a human hand is insertable, wherein from a centerline evenly positioned between the front surface and the rear surface, the first and the second opening are forward biased towards the front surface, said forward bias being such that ten percent to forty percent of the periphery of the first and second opening are rearward of the centerline and ninety to sixty percent of the periphery of the first and second openings are frontward of the centerline, wherein each of said first and second openings are upwardly angled from the centerline to the front surface at an angle between fifteen and fifty degrees relative to the bottom surface; and a lid for the container structure, wherein said lid comprises a first lid opening and a second lid opening, said first lid opening being a void within the lid that corresponds in opening periphery and angle with the first opening of the first side, wherein the second lid opening is a void that correspond in opening periphery and angle with the second opening of the second side, wherein the first and second lid openings are such that when the lid is placed over the top opening, the first lid opening aligns with the first opening and the second lid opening aligns with the second opening.

15. The box of claim 14, wherein the first and second openings are shaped and aligned in corresponding positions for a right hand and a left hand grip respectively.

16. The box of claim 14, wherein the forward bias results in between ten percent and twenty percent of the periphery of the first and second opening being rearward of the centerline and between eighty and ninety percent of the periphery of the first and second opening being forward of the centerline.

17. The box of claim 14, wherein the forward bias results in between twenty percent and thirty percent of the periphery of the first and second opening being rearward of the centerline and between seventy and eighty percent of the periphery of the first and second opening being forward of the centerline.

18. The box of claim 14, wherein the forward bias results in between thirty percent and forty percent of the periphery of the first and second opening being rearward of the centerline and between sixty and seventy percent of the periphery of the first and second opening being forward of the centerline.

19. The box of claim 14, wherein each of said first and second openings are upwardly angled from the centerline to the front surface at an angle between fifteen and twenty-five degrees relative to the bottom surface.

20. The box of claim 14, wherein each of said first and second openings are upwardly angled from the centerline to the front surface at an angle between twenty-five and thirty-five degrees relative to the bottom surface.

21. The box of claim 14, wherein each of said first and second openings are upwardly angled from the centerline to the front surface at an angle between thirty-five and forty-five degrees relative to the bottom surface.

22. The box of claim 14, wherein a height and length of the first and second sides are along an x and y axis, wherein the first opening and the second opening are part of a movable structure of the first and second sides, such that the movable structures are movable about a z-axis at an angle between ten and seventy degrees.

* * * * *